US005362991A

United States Patent [19]

Samela

[11] Patent Number: 5,362,991

[45] Date of Patent: Nov. 8, 1994

[54] ACTIVE DEASSERTION CIRCUIT

[76] Inventor: Francis M. Samela, 316 W. Goebel Dr., Lombard, Ill. 60148

[21] Appl. No.: 988,908

[22] Filed: Dec. 10, 1992

[51] Int. Cl.[5] ..... G05F 1/46

[52] U.S. Cl. ..... 327/540; 323/315; 327/322; 327/575

[58] Field of Search ..... 307/296.6, 296.4, 540, 307/542, 315; 330/257; 323/315

[56] References Cited

U.S. PATENT DOCUMENTS

| | | | |
|---|---|---|---|
| 3,619,659 | 9/1971 | Meyer | 307/263 |
| 4,339,677 | 7/1982 | Hoeft | 307/564 |
| 4,434,403 | 2/1984 | Chang | 307/296.4 |
| 4,536,667 | 8/1985 | Masuda | 307/296.4 |
| 4,831,283 | 5/1989 | Newton | 307/443 |
| 4,920,339 | 4/1990 | Friend et al. | 340/825 |
| 5,010,293 | 2/1991 | Ellersick | 323/278 |
| 5,027,004 | 6/1991 | Palara | 307/315 |
| 5,028,820 | 7/1991 | Sullivan | 307/455 |
| 5,072,169 | 12/1991 | Saul et al. | 323/220 |
| 5,182,526 | 1/1993 | Nelson | 330/257 |
| 5,239,559 | 8/1993 | Brach et al. | 302/542 |

OTHER PUBLICATIONS

Texas Instruments' publication (pp. 3, 4).

*Primary Examiner*—Timothy P. Callahan
*Assistant Examiner*—Dinh Le
*Attorney, Agent, or Firm*—David L. Newman

[57] ABSTRACT

An active deassertion circuit is a device that prevents signal lines used with a communications protocol from drawing too much current. Thus, the device prevents the driver(s) of the signal lines from malfunctioning and/or being damaged. The active deassertion circuit is comprised of a voltage regulator, with peripheral connections, coupled to a transistor that is used to sink excess current. The function of these elements ensures that no asserted signal line draws too much current if another signal line is actively deasserted. A method of using the active deassertion circuit is also disclosed.

10 Claims, 2 Drawing Sheets

ACTIVE DEASSERTION CIRCUIT

BACKGROUND OF THE INVENTION

The present invention relates to communication systems having at least two electronic units capable of communicating via a transmission line. The units communicate over the transmission line via a protocol. More specifically, the transmission line is comprised of a plurality of signal lines which may be in one of three states, namely the asserted state, the deasserted state, or the actively deasserted state. The present invention is a device, and a method for using the same, that prevents asserted signal lines or signal lines that are going to be asserted from drawing current in excess of the protocol's specification. While those of skill in the art realize that there are many systems with which this invention may be used, the invention will be described within the framework of the Small Computer System Interface (SCSI) system as described in American National Standard for Information Systems X3T9.2/82-2 (hereinafter "the ANSI standard").

An SCSI system has a transmission line over which a plurality of units coupled to the transmission line may communicate. A regulated terminator, in accordance with the ANSI standard, is coupled to the two physical ends of the transmission line.

The SCSI system has drivers which drive the individual signal lines of the transmission line. A signal line may be in one of three states. First, a signal line is said to be "asserted" if a driver drives the signal line to ground. Second, signal lines that are released from the asserted state are said to be "deasserted." Third, signal lines that are driven from the asserted state by a driver are said to be "actively deasserted."

The ANSI standard requires that asserted signal lines draw no more than 24 milliamperes (mA) of current. However, it has previously been difficult, if not impossible, to comply with this standard when active deassertion is used.

Deasserted signal lines have 2.85 volts on them because the regulated terminator made in accordance with the ANSI standard has a 2.85 volt voltage regulator that pulls deasserted lines up to 2.85 volts. If other signal lines are asserted (i.e., grounded), they will draw no more than the 24 mA allowed by the ANSI standard due to the 110 ohm resistor in each signal line [(2.85−$V_{ol}$ of driver)/110 ohms].

However, when a signal line is actively deasserted, it may have anywhere from 3.0 to 5.0 volts on the line. Since the voltage regulator of the regulated terminator cannot sink current, this higher voltage on the actively deasserted signal line is not regulated to 2.85 volts. Thus, if a signal line is asserted, it will draw more than 24 mA (e.g., 4.0 volts/110 ohms=36 mA). This may damage the driver or cause it to malfunction.

Although others have attempted to address driver damage and/or malfunction, attempts have fallen short of an adequate solution. For instance, Texas Instruments claims that its part number TL1431 can be used, along with other components, to sink current such that it is possible for an asserted signal line to draw an amount of current within the ANSI standard even if another signal line is actively deasserted. However, the TL1431, by Texas Instruments' admission, is limited to applications wherein only a limited number of signal lines are actively deasserted.

Accordingly, the primary object of this invention is to provide a device, and method for using the same, which complies with the ANSI standard in that it will not allow an asserted signal line to draw more current than is specified by the ANSI standard, in cases where the maximum allowable number of signal lines are actively deasserted.

Further objects and advantages of the present invention will become apparent in the following description.

SUMMARY OF THE INVENTION

The present invention provides an active deassertion circuit and a method of using the same. The active deassertion circuit is comprised of a means for providing a voltage reference that has an input and an output. Further, the active deassertion circuit also has a means for sinking current that has a first input, a second input, and an output. The first input of the means for sinking current is coupled to the output of the means for providing a voltage reference. The means for sinking current compares the first input to the second input. If the voltage at the second input is too high, as compared to the voltage at the first input, due to active deassertion of at least one signal line of the transmission line, the means for sinking current sinks enough current to prevent an overcurrent condition on signal lines that are asserted or are going to be asserted.

DETAILED DESCRIPTION OF THE DRAWINGS

For a better understanding of the invention, reference may be had to the following description taken in conjunction with the accompanying drawings, wherein.

DETAILED DESCRIPTION OF THE PREFERRED EMBODIMENT

As previously mentioned, those of skill in the art know that there are many systems with which this invention may be used and conducted. However, for the sake of brevity, the invention will be described within the framework of a SCSI system only.

Figure 1:
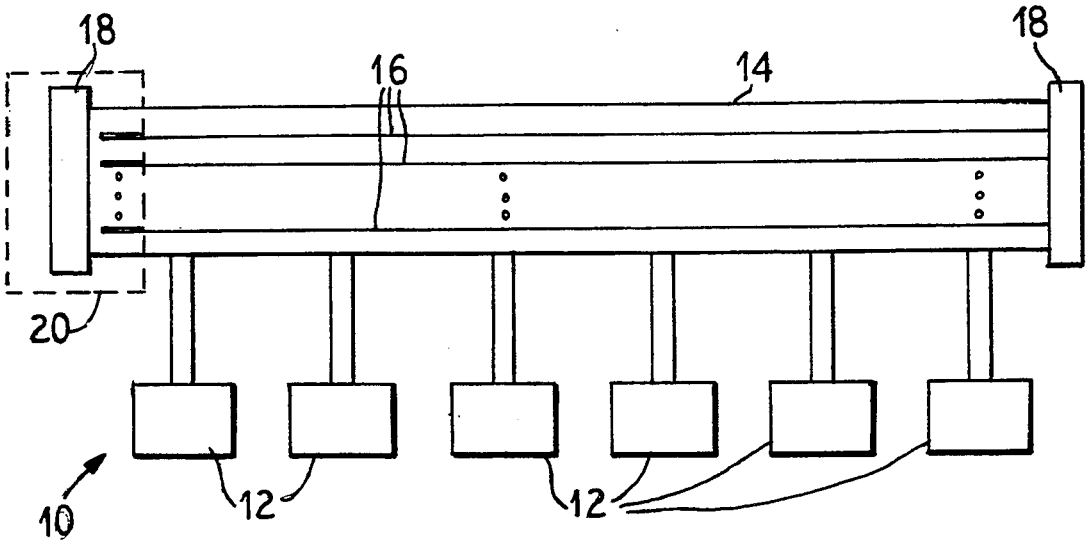
FIG. 1 shows a SCSI system that has a plurality of electronic units capable of communicating with each other via a transmission line.

Referring initially to FIG. 1, a SCSI system 10 has a plurality of units 12 arranged in a daisy chain configuration. The plurality of units 12 communicate via a transmission line 14 in conformance with the ANSI standard. The transmission line 14 is comprised of a plurality of signal lines 16. A regulated terminator 18 is coupled to each physical end of the transmission line 14. The area of the SCSI system 10 within the area marked with reference numeral 20 will be shown and described in more detail with reference to FIG. 3.

Figure 2:
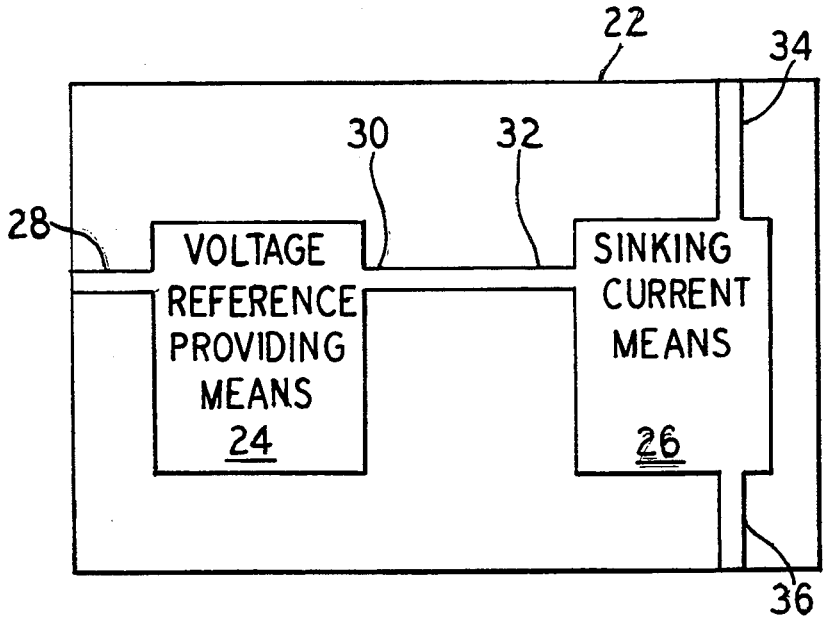
FIG. 2 shows a block diagram of an active deassertion circuit made in accordance with the present invention.

FIG. 2 shows an active deassertion circuit 22 in block diagram form. The active deassertion circuit 22 is comprised of a means for providing a voltage reference 24 and a means for sinking current 26. The means for providing a voltage reference 24 has an input 28 and an output 30. The means for sinking current 26 has a first input 32 that is coupled to the output 30 of the means for providing a voltage reference 24. The means for sinking current 26 also has a second input 34 and an output 36.

Figure 3:
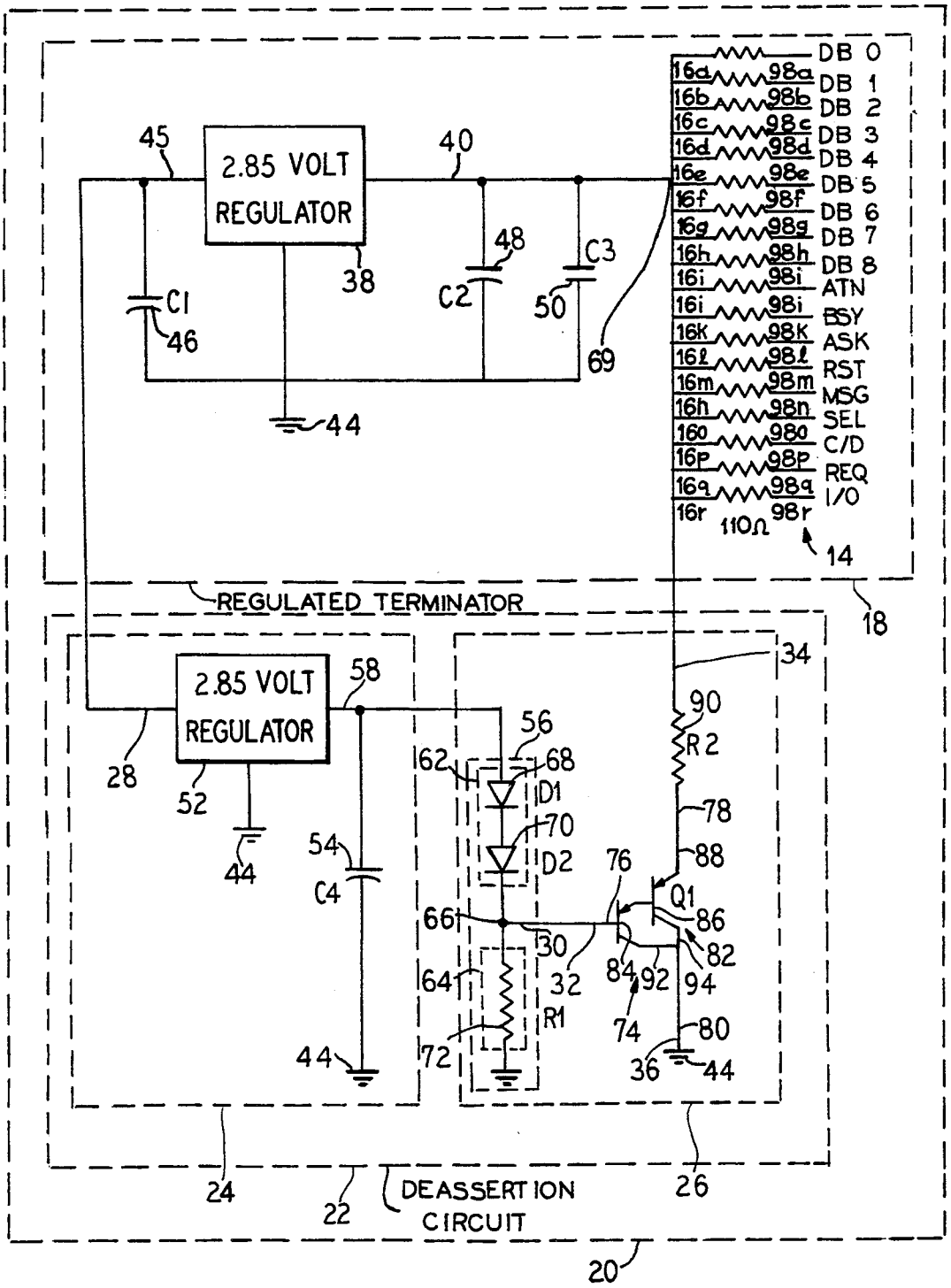
FIG. 3 shows a detailed schematic of the active deassertion circuit of FIG. 2 and its placement within a part of the SCSI system.

FIG. 3 shows the active deassertion circuit 22 and its placement within the SCSI system 10 denoted by reference numeral 20 of FIG. 1. The regulated terminator 18 is comprised of a 2.85 volt voltage regulator 38, the output 40 of which is coupled to each signal line 16*a* through 16*r* of the transmission line 14. The voltage regulator 38 is connected to a common voltage 44. Other features of the regulated terminator 18, such as its input 45 and its capacitors 46, 48, and 50, are connected as shown. The means for sinking current 26 of the active deassertion circuit 22 is coupled to each signal line, 16*a* through 16*r*, and the output 40 of the voltage regulator 38 via its second input 34. These are the only connections that need be made between the SCSI system 10 and the active deassertion circuit 22. However, preferably, the input 28 of the means for providing a voltage reference 24 is connected to the input 45 of the regulated terminator 18 which enables both the regulated terminator 18 and the active deassertion circuit 22 to operate off of the same power means (not shown).

Again referring to FIG. 3, the means for providing a voltage reference 24, or voltage reference circuit, is preferably comprised of a voltage regulator 52, a capacitor 54, and voltage divider circuitry 56. The voltage regulator 52 has an input 28 that is identical to the input 28 of the means for providing a voltage reference 24. The voltage regulator has an output 58 and is connected to the common voltage 44, preferably ground. Preferably, the voltage regulator 52 is part number LT11172.85 manufactured by Linear Technology Corporation. The capacitor 54 is interposed between the output 58 of the voltage regulator 52 and the common voltage 44 and is, preferably, a 22 microfarad capacitor. The voltage divider circuitry 56 is interposed between the output 58 of the voltage regulator 52 and the common voltage 44. The voltage divider circuitry 56 is comprised of diode means 62 serially connected with impedance means 64 at a junction 66 that serves as the output 30 of the means for providing a voltage reference 24. Preferably, the diode means 62 is part number BAV99, manufactured by Phillips. Thus, it is manifest that the capacitor 54 and the voltage divider circuitry 56 are in parallel with each other. Preferably, the diode means 62 is comprised of a pair of diodes, 68 and 70, interposed between the output 58 of the voltage regulator 52 and the output 30 of the means for providing a voltage reference 24, or junction 66. Also, the impedance means 64 is preferably a resistor 72 that is interposed between the junction 66 and the common voltage 44 having a value of 3.3 KOhms.

Yet again referring to FIG. 3, the means for sinking current 26, or current sink, is comprised of transistor means 74 having a base 76, emitter 78, and a collector 80. The base 76 serves as the first input 32 to the means for sinking current 26 and is coupled to the junction 66. Preferably, the transistor means 74 is comprised of a Darlington transistor 82 arranged from two pnp transistors, 84 and 86, as shown. Preferably, the Darlington transistor 82 is part number FTZ705, manufactured by Zetex. In this configuration an emitter 88 of transistor 86, and thus the emitter 78 of the transistor means 74, has a resistor 90, preferably with a value of 0.22 ohms, connected to it. The resistor 90 serves as the second input 34 to the means for sinking current 26. Further, in this configuration, the collectors 92 and 94 of the transistors 84 and 86, respectively, serve as the output 36 to the means for sinking current 26 and the collector 80 of the transistor means 74. Preferably, the output 36 is connected to the common voltage 44 as shown.

Again referring to FIG. 3, by its very nature, the quiescent operating point of the Darlington transistor 82 will not be stable over the entire environmental temperature range over which the active deassertion circuit 22 may operate. However, matching the temperature coefficient of diode means 62 with the temperature coefficient of the junction of the emitter 78 and the base 76 alleviates this problem. Thus, although, for instance, one can practice the claimed invention by using a zener diode (not shown) as the means for providing a voltage reference 24, a zener diode is not the preferable structure.

Still referring to FIG. 3, the second input 34 is coupled to both the output 40 of the voltage regulator 38 of the regulated terminator 18 and the signal lines, 16*a* through 16*r*, at a node 96. If there are no actively deasserted signal lines, 16*a* through 16*r*, the voltage regulator 38 will provide a voltage of 2.85 volts at the second input 34. However, if a signal line, 16*a* through 16*r*, is actively deasserted, the node 96 will be at a voltage greater than 2.85 volts due to characteristics of the drivers (not shown). Since each of the signal lines, 16*a* through 16*r*, has a 110 ohm resistor, 98*a* through 98*r*, an asserted line will normally draw more than 24 mA (which is outside of the ANSI standard) if an active deassertion circuit 22 is not present. In fact, the more signal lines, 16*a* through 16*r*, that are deasserted, the farther the current through each asserted line exceeds the maximum current allowed by the ANSI standard due to the increase in the overall current through the signal lines, 16*a* through 16*r*.

Having described the structure of the active deassertion circuit 22 and its connections to the SCSI system 10, the method of use of the active deassertion circuit 22 will be apparent to those of skill in the art. The method of use prevents overcurrent on signal lines, 16*a* through 16*r*, due to the active deassertion of at least one other signal line, 16*a* through 16*r*. First, one must provide a regulated terminator 18 having an output 40. Next, one must couple a plurality of signal lines, 16*a* through 16*r*, to the output 40 of the regulated terminator. Next, one may couple the second input 34 of the active deassertion circuit 22 to the output 40. Next, one must assert at least one of the plurality of signal lines, 16*a* through 16*r*. Next, one must actively deassert at least one of the plurality of signal lines, 16*a* through 16*r*. Next, one must compare the first input 32 of the means for sinking current 26 to the second input 34 of the means for sinking current 26. Finally, one must sink current through the means for sinking current 26 until none of the asserted plurality of signal lines, 16*a* through 16*r*, draws current in excess of that which is permitted by its communications protocol.

The invention has been described in detail with particular reference to an active deassertion circuit 22 comprised of a means for providing a reference voltage 24 and a means for sinking current 26. However, those skilled in the art understand that there are numerous variations and modifications of the present invention. For instance, as explained above, the present invention could use a zener diode as the means for providing a voltage reference 24 and still fall within the ambit of the claims. Also, any temperature compensating voltage reference can be used in place of the voltage reference 24. While these are some of the variations and modifications which can be made to the present invention, those of ordinary skill in the art understand that other variations and modifications can be effected within the spirit and scope of the invention as described here and above and as defined in the appended claims.

What I claim is:

1. An active deassertion circuit for a regulated terminator, said regulated terminator providing a constant voltage output to a plurality of signal lines comprising:
(a) means for providing a voltage reference having an input and an output; and
(b) means for sinking current having a first input, a second input, and an output, the first input being coupled to the output of the means for providing a voltage reference and the second input being coupled to said constant voltage output of the regulated terminator;
whereby the means for sinking current is capable of comparing its first input to its second input and, when voltage at the second input momentarily exceeds the first input due to active deassertion of at least one signal line of said plurality of signal lines, sinking current to prevent overcurrent on the other signal lines that are asserted or are going to be asserted to maintain said constant voltage.

2. The active deassertion circuit of claim 1 wherein the means for sinking current is comprised of transistor means having a base, an emitter, and a collector.

3. The active deassertion circuit of claim 2 wherein the transistor means is comprised of a Darlington transistor, the base of the Darlington transistor serving as the first input to the means for sinking current.

4. The active deassertion circuit of claim 3 wherein the Darlington transistor is comprised of a pair of pnp transistors, a resistor being coupled to the emitter of the Darlington transistor and serving as the second input to the means for sinking current, the collector serving as the output to the means for sinking current.

5. The active deassertion circuit of claim 4 wherein the collector is coupled to a common voltage.

6. An active deassertion circuit comprising:
(a) a voltage reference circuit having;
(i) a voltage regulator having an input, an output and a ground connection;
(ii) a capacitor interposed between the output of the voltage regulator and the ground connection;
(iii) voltage divider circuitry having a junction and being interposed between the ground connection and the output of the voltage regulator, the voltage divider circuitry also having:
(1) a pair of diodes interposed between the output of the voltage regulator and the junction; and
(2) a resistor interposed between the junction and the ground connection; and
(b) a current sink having a first input, a second input, and an output, the current sink comprising:
(i) a Darlington transistor having a base, an emitter and a collector, the base being the same as the first input of the current sink and being coupled to the junction, the collector being coupled to the ground connection; and
(ii) a resistor having a first end and a second end, the first end being the same as the second input of the current sink and the second end being connected to the emitter of the Darlington transistor.

7. The active deassertion circuit of claim 6 wherein the pair of diodes has a temperature coefficient that is about the same as the temperature coefficient of the Darlington transistor whereby the effect of the temperature of the environment in which the active deassertion circuit is used will be minimized.

8. A method of preventing overcurrent on signal lines due to the active deassertion of at least one other signal line of a plurality of signal lines comprising the steps of:
(a) providing a regulated terminator having a constant voltage output;
(b) coupling a plurality of signal lines to the output of the regulated terminator;
(c) coupling an active deassertion circuit to the output of the regulated terminator, the active deassertion circuit having means for providing a voltage reference and means for sinking current, the means for sinking current having a first input, a second input, and an output;
(d) asserting at least one of the plurality of signal lines at said second input of said sinking current means;
(e) actively deasserting at least one of the plurality of signal lines causing a momentary excess voltage;
(f) comparing the first input of the means for sinking current to the second input of the means for sinking current; and
(g) sinking current through the means for sinking current until none of the asserted plurality of signal lines draws current in excess of that which is permitted by its communications protocol to thereby maintain said constant voltage.

9. An active deassertion circuit for a regulated terminator, the regulated terminator providing a constant voltage output to at least one of a plurality of signal lines comprising:
(a) means for providing a voltage reference having an input and an output; and
(b) means for sinking current having a first input, a second input, and an output, the first input being coupled to the output of the means for providing a voltage reference and the second input being coupled to said constant voltage output of the regulated terminator;
whereby the means for sinking current is capable of comparing its first input to its second input and, when voltage at the second input momentarily exceeds the first input due to active deassertion of at least one signal line of said at least one of said plurality of signal lines, sinking current to prevent overcurrent on other signal lines that are asserted or are going to be asserted to maintain said constant voltage wherein the means for providing a voltage reference is further comprised of:
(a1) a voltage regulator having an input and an output, the input of the voltage regulator serving as the input of the means for providing a voltage reference;
(a2) a capacitor interposed between the output of the voltage regulator and a common voltage; and
(a3) diode means serially connected with impedance means at a junction, the diode means and the impedance means being interposed between the output of the voltage regulator and the common voltage, the junction serving as the output of the means for providing a voltage reference.

10. The active deassertion circuit of claim 9 wherein the diode means is comprised of a pair of diodes in series and the impedance means is comprised of a resistor, the pair of diodes in series being interposed between the output of the voltage regulator and the junction and the resistor being interposed between the junction and the common voltage.

* * * * *